US005439409A

United States Patent [19]

McCracken et al.

[11] Patent Number: 5,439,409

[45] Date of Patent: Aug. 8, 1995

[54] BREAST PROTECTOR AND ASSEMBLY

[75] Inventors: Jamie L. McCracken; Kathy L. Goff, both of Stillwater, Okla.

[73] Assignee: Turtle Shells Corporation, Stillwater, Okla.

[21] Appl. No.: 84,046

[22] Filed: Jun. 28, 1993

[51] Int. Cl.[6] ..... A41C 3/10; A41C 3/14

[52] U.S. Cl. ..... 450/31; 450/32; 450/54; 450/57; 2/2.5; 2/267

[58] Field of Search ..... 2/2.5, 73, 267, 268; 450/30, 31, 32, 37, 39, 40, 53, 54, 55, 56, 57; 623/7, 8

[56] References Cited

U.S. PATENT DOCUMENTS

| | | | |
|---|---|---|---|
| 1,721,739 | 7/1929 | Kennedy . | |
| 2,495,307 | 1/1950 | Abramson . | |
| 2,579,365 | 12/1951 | Condé | 450/39 |
| 2,940,453 | 6/1960 | Lerner | 450/30 |
| 3,176,686 | 4/1965 | Barnes . | |
| 3,478,739 | 11/1969 | Librande . | |
| 3,532,096 | 10/1970 | Seidl . | |
| 3,721,997 | 3/1973 | Mundt | 2/46 |
| 3,772,899 | 11/1973 | Novi | 450/39 X |
| 4,035,440 | 7/1977 | Khanna et al. | 260/859 R |
| 4,199,825 | 4/1980 | Knoche | 450/55 X |
| 4,566,458 | 1/1986 | Weinberg . | |
| 4,578,821 | 4/1986 | Zufle | 2/2.5 |
| 5,022,887 | 6/1991 | Lawson | 450/32 X |
| 5,032,103 | 1/1993 | Larsson . | |
| 5,180,326 | 1/1993 | Williams | 2/73 X |
| 5,244,432 | 9/1993 | Moy Au et al. | 450/54 |
| 5,281,186 | 1/1994 | Buckley et al. | 450/57 X |

*Primary Examiner*—Jeanette E. Chapman
*Attorney, Agent, or Firm*—Dunlap & Codding

[57] ABSTRACT

A breast protector and assembly are provided. The breast protector comprises a retention cup constructed of a semi-rigid material and formed into a demi-teardrop shape which approximates the natural shape of an unsupported female breast. The retention cup can have padding permanently or removably attached to an inner surface of the retention cup. A breast protector assembly comprises two retention cups fitted into a retention cup sleeve composed of a semi-elastic material in the shape of a tube. The retention cup assembly is sized so that the retention cups fit securely within the tube. The retention cup assembly can fit within the cups of an ordinary brassiere, being held thereby against the body of the wearer. Alternately, the retention cup assembly can be sewn into the brassiere.

1 Claim, 2 Drawing Sheets

BREAST PROTECTOR AND ASSEMBLY

FIELD OF THE INVENTION

This invention relates to chest protectors in general and more specifically to breast protectors for cushioning mammary tissue from shocks associated with outdoor and athletic events.

DESCRIPTION OF THE PREFERRED EMBODIMENTS

Figure 2:
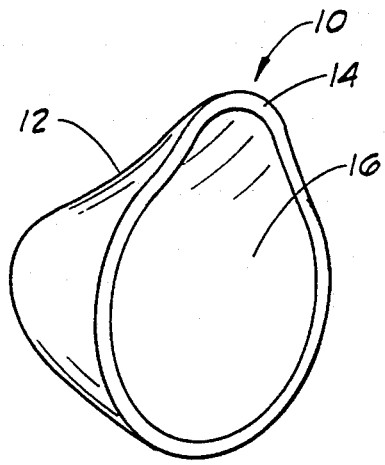
FIG. 2 shows a rear perspective view of a breast protector retention cup constructed in accordance with the present invention.

Shown in FIG. 2 is a demi-teardrop shaped breast protector constructed in accordance with the present invention. The breast protector comprises a retention cup generally designated herein with the reference numeral 10. The retention cup 10 comprises a sidewall defining a generally demi-teardrop shaped cavity; the sidewall having an outer surface 12, an inner surface 16, and a periphery 14.

Figure 1:
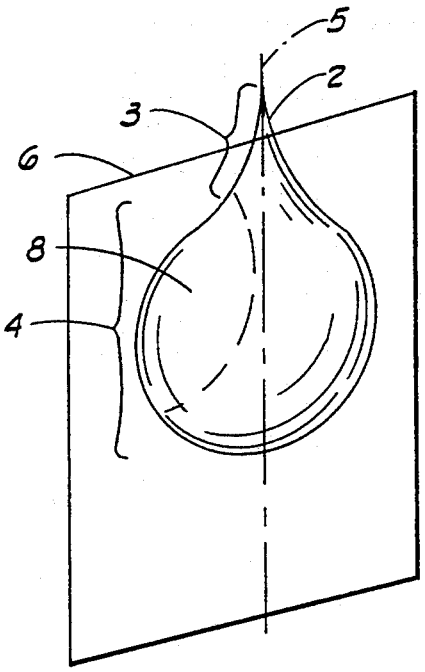
FIG. 1 shows a perspective view of a plane bisecting a teardrop and defining a demi-teardrop shape.

Shown in FIG. 1, is a perspective view of a teardrop 2 suspended in free space. The teardrop 2 comprises a neck 3 and a body 4. The teardrop 2 has an axis 5 which extends vertically through the teardrop 2 such that the teardrop 2 is symmetrical about the axis 5 at any points on the teardrop 2 bisected by a plane perpendicular to the axis 5. As shown in FIG. 1, the plane 6, which is parallel to the axis 5, defines a section 8 which includes a portion of the neck 3 and the body 4 of the teardrop 2. The section 8 comprises a shape which is known herein as a "demi-teardrop shape". The demi-teardrop shape of section 8 approximately defines the shape of an unsupported human female breast.

Figure 3:
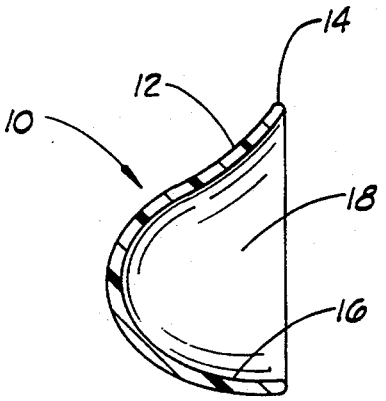
FIG. 3 shows a cut away side view of the retention cup shown in FIG. 2.

FIG. 3 shows a side cut away view of the retention cup 10 shown in FIG. 2. The retention cup 10 comprises a sidewall having an outer surface 12, an inner surface 16, and a periphery 14, the periphery 14, in a preferred embodiment of the invention, comprising a curved lip. The retention cup 10 generally defines a demi-teardrop shape, and encloses a generally demi-teardrop shape cavity 18. As shown in FIG. 3, a preferred embodiment of the retention cup 10 will include a periphery 14 having a curved lip, the curved lip acting to reduce the possibility of abrasion.

Figure 4:
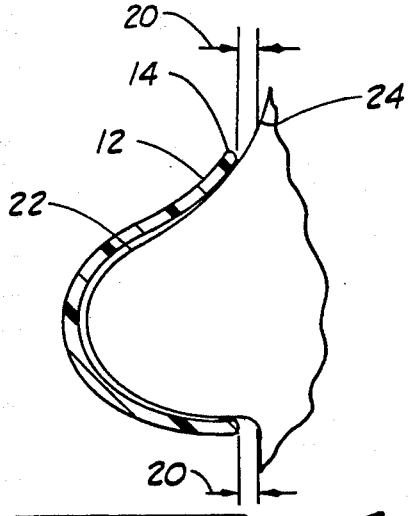
FIG. 4 shows a cut away side view of the retention cup shown in FIG. 3, with a human female breast disposed therein.

FIG. 4 is a cut away side view of the retention cup 10 shown in FIG. 3, showing a human female breast 22 disposed therein. A surface of the breast 22 is generally adjacent the inner surface 16 of the retention cup 10. As shown in FIG. 4, the periphery 14 of the retention cup 10 is disposed a distance 20 away from a torso 24, when the breast 22 is disposed within the retention cup 10. The distance 20 is significant to the operation of the invention, because when a shock is applied to the breast 22, as from a blow, the backward movement of the breast 22 tends to cushion the blow, thereby allowing the breast 22 to act as a "shock absorber". Additionally, the distance 20 prohibits the retention cup 10 from wearing or chafing against the torso 24.

In one preferred embodiment of the invention, the retention cup 10 is constructed of a plastic comprising approximately seventy five percent polyethylene and twenty five percent of a thermoplastic elastomer. In another embodiment, the retention cup 10 is constructed of dense rubber or foam.

Figure 5:
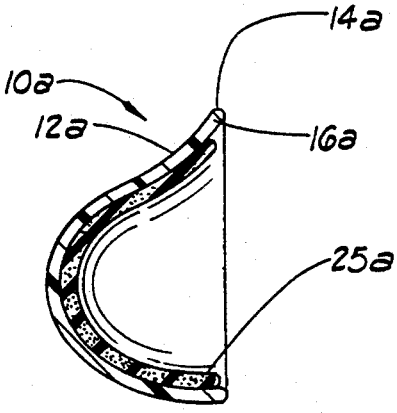
FIG. 5 shows a cut away side view of a retention cup constructed in accordance with the present invention, having padding disposed adjacent the inner surface.

FIG. 5 shows a retention cup **10*a*, constructed similarly to the retention cup 10 shown in FIGS. 2, 3 and 4, but having a padding 25*a* disposed adjacent an inner surface 16*a* of the retention cup 10*a*. The padding 25*a* can be permanently attached to the inner surface 16*a* of the retention cup 10*a*, or it may be detachably connected to the inner surface 16*a* of the retention cup 10*a*, so that the padding 24*a* can be removed from the inner surface 16*a* as, for example, to launder the padding 25*a***.

Figure 6:
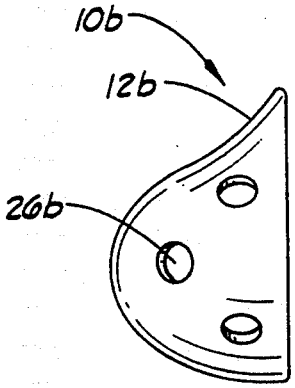
FIG. 6 shows a side view of a retention cup constructed in accordance with the present invention, having a plurality of holes piercing the sidewall.

FIG. 6 shows a side view of retention cup **10*b* constructed in accordance with the present invention. The retention cup 10*b* has an outer surface 12*b*, and further has a plurality of holes piercing the sidewall of the cup 10*b*, one of the holes being shown and designated by the numeral 26*b*. The holes penetrate the outer surface 12*b* and extend into the interior of the retention cup 10*b*. The retention cups 10, 10*a* or 10*b* can be fitted directly into the support cups of a brassier which is thereafter donned by a wearer, the retention cups 10, 10*a* or 10*b*** acting to protect the breasts of the wearer, while presenting a natural, unconfined appearance.

Figure 7:
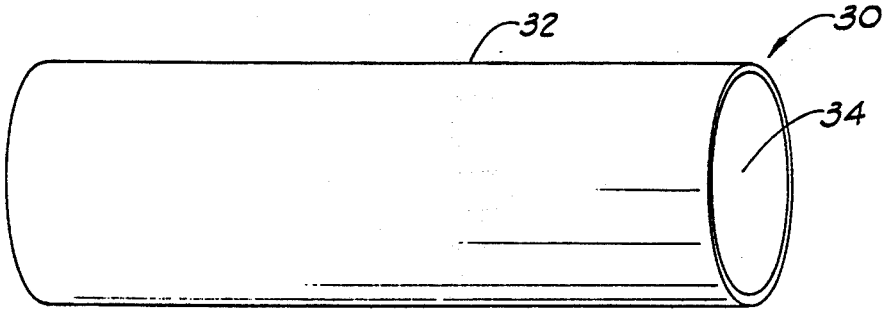
FIG. 7 shows a perspective view of a retention cup sleeve constructed in accordance with the present invention.

FIG. 7 shows a retention cup sleeve 30. The retention cup sleeve 30 comprises a continuous sidewall 32 defining an annular space having a first opening end 34 and a second opening end 36. The continuous sidewall 32 is composed of a semi-elastic material. In a preferred embodiment, the continuous sidewall 32 comprises a cloth material of fifty percent cotton, fifty percent polyester mix. The retention cup sleeve 30 is sized to permit the insertion of retention cups 10 into the annular space by way of the first opening end 34 and the second opening end 36, such that the retention cups 10 are held essentially immovable within the retention cup sleeve 30. The fit of the retention cups 10 within the retention cup sleeve 30 requires that the material of the retention cup sleeve 30 stretched slightly, thereby, when retention cups 10 are inserted therein, securing the retention cups 10.

Figure 8:
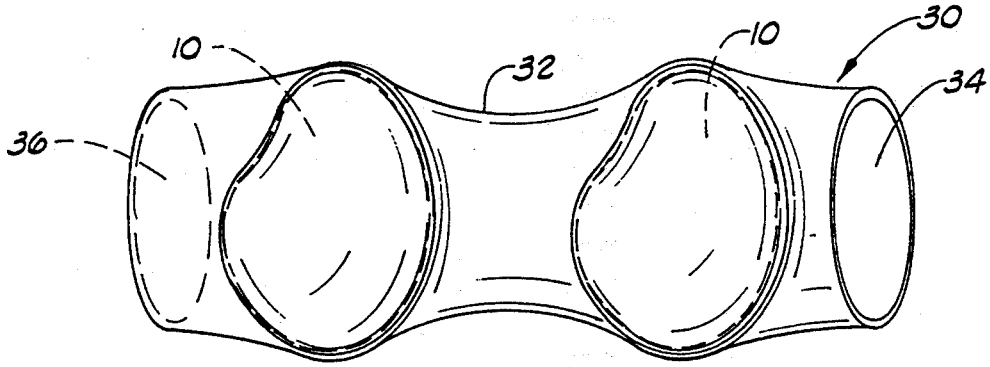
FIG. 8 shows a perspective view of the retention cup sleeve shown in FIG. 7, with two retention cups disposed therein.

Shown in FIG. 8 is the retention cup sleeve 30 shown in FIG. 8, with two retention cups 10 disposed in the annular space 34 thereof. In this embodiment of the invention, each of the retention cups 10, disposed within a portion of the sleeve 30, is subsequently fitted into the support cups of a brassiere. The brassiere can then be worn, with the retention cups 10 fitted within the retention cup sleeve 30 providing protection to the wearer against shocks to the breasts, while at the same time, providing a generally natural and unconfined appearance.

Figure 9:
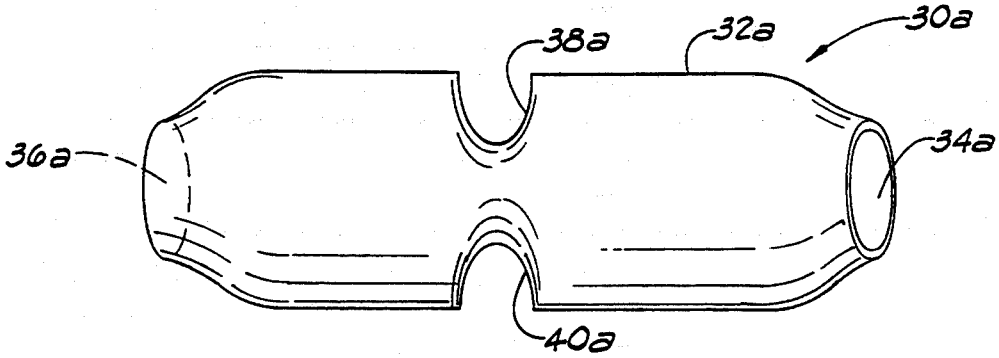
FIG. 9 shows another embodiment of the retention cup sleeve.

Shown in FIG. 9 is another embodiment of the retention cup sleeve, designated by the numeral 30*a*. The sleeve 30*a* includes a sidewall 32*a* defining an annular space having a first opening end 34*a* and a second opening end 36*a*. The first and second opening ends 34*a* and 36*a* are circumferentially contained by flexible restriction members, such as an elastic band, so that the diameter of the opening ends 34*a* or 34*a*, in a relaxed condition, is generally smaller than the diameter of the annular space. Additionally, the sidewall is pierced by a first notch 38*a* and a second notch 40*a*.

Figure 10:
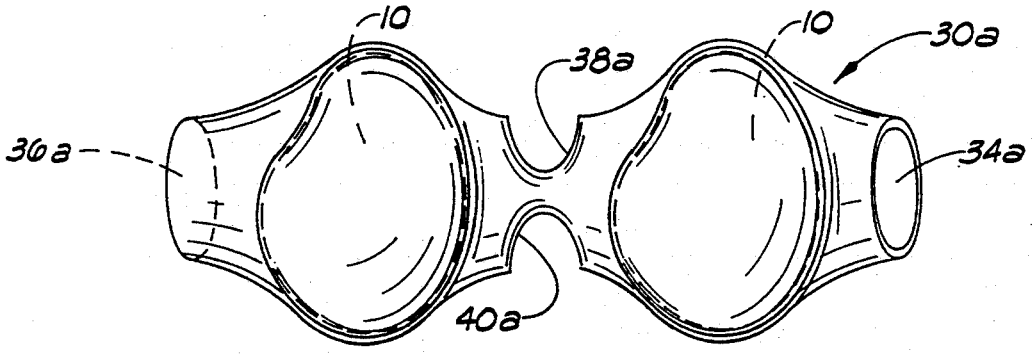
FIG. 10 shows a perspective view of the retention cup sleeve shown in FIG. 9, with two retention cups disposed therein.

Shown in FIG. 10 is the retention cup sleeve 30*a* with two retention cups 10 disposed therein. The opening ends 34*a* and 36*a*, when stretched into an expanded condition, permit the ingress of the cups 10 into the annular space of the sleeve 30*a*. The first and second notches 38*a* and 40*a* operate to restrict the lateral movement of the cups 10 within the sleeve 30*a*.

In operation, the cups 10, disposed within a portion of the sleeve 30*a*, are fitted into the support cups of a brassiere. The brassiere can then be worn, with the cups 10 fitted within the sleeve 30*a* providing protection to the wearer against shocks to the breasts. Alternatively, the sleeves 30 and 30*a* shown in FIGS. 7 and 9 can be sewn into or otherwise connected to the brassiere such that the ends 32 and 34, or 32*a* and 34*a* respectively, are free to accept retention cups 10.

Changes may be made in the construction and the operation of the various components, elements and assemblies described herein and changes may be made in the steps or the sequence of steps of the methods described herein without departing from the spirit and scope of the invention as defined in the following claims.

What is claimed is:

1. The breast protector assembly, comprising:

two retention cups and a retention cup sleeve connected to a brassiere having support cups, the retention cup sleeve comprising a semi-elastic material and having a continuous sidewall defining an annular opening therethrough, wherein the retention cup sleeve is capable of accepting the two retention cups and holding the retention cups essentially immovable within the sleeve, and wherein the breast protector assembly is at least partially disposed into the support cups of the brassiere.

* * * * *

UNITED STATES PATENT AND TRADEMARK OFFICE

CERTIFICATE OF CORRECTION

PATENT NO. : 5,439,409

DATED : August 8, 1995

INVENTOR(S) : McCracken et al.

It is certified that error appears in the above-identified patent and that said Letters Patent is hereby corrected as shown below:

Column 1, line 68, please delete "shape" and substitute therefor -- shaped --.

Column 2, line 32, please delete "padding 24a" and substitute therefor -- padding 25a --.

Column 2, line 61, after "sleeve 30" please insert -- be --.

Column 3, line 14, please delete "opening ends 34a or 34a" and substitute therefor -- opening ends 34a or 36a --.

Column 4, line 5, please delete "ends 32 and 34, or 32a and 34a" and substitute -- ends 34 and 36, or 34a and 36a --.

Signed and Sealed this

Third Day of June, 1997

*Attest:*

Bruce Lehman

BRUCE LEHMAN

*Attesting Officer*

*Commissioner of Patents and Trademarks*